US006502914B2

(12) United States Patent
Hosono et al.

(10) Patent No.: US 6,502,914 B2
(45) Date of Patent: Jan. 7, 2003

(54) INK-JET RECORDING APPARATUS AND METHOD FOR DRIVING INK-JET RECORDING HEAD

(75) Inventors: Satoru Hosono, Nagano-Ken (JP); Kenji Otokita, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/835,567

(22) Filed: Apr. 17, 2001

(65) Prior Publication Data

US 2002/0167559 A1 Nov. 14, 2002

(30) Foreign Application Priority Data

Apr. 18, 2000 (JP) ..... 2000-116796
Apr. 19, 2000 (JP) ..... 2000-118141
Mar. 16, 2001 (JP) ..... 2001-076398

(51) Int. Cl.[7] ..... B41J 2/01
(52) U.S. Cl. ..... 347/11
(58) Field of Search ..... 347/9–11, 68

(56) References Cited

U.S. PATENT DOCUMENTS 4,112,433 A * 9/1978 Vernon ..... 347/11
6,186,610 B1 * 2/2001 Kocher et al. ..... 347/11
6,450,603 B1 * 9/2002 Chang ..... 347/11

* cited by examiner

*Primary Examiner*—Craig Hallacher
(74) *Attorney, Agent, or Firm*—Wenderoth, Lind & Ponack, L.L.P.

(57) ABSTRACT

The drive signal supplied to the piezoelectric vibrator includes the expansion waveform elements (P1, P2, and P3) for expanding the pressure generating chamber, the contraction waveform element (P5) for contracting the pressure generating chamber expanded by the expansion waveform element and jetting an ink drop from the nozzle opening, and the vibration damping waveform element (P7) changing from the terminal voltage (VL) of the contraction waveform element (P5) to the vibration damping voltage (VM) so as to suppress the residual vibration of the meniscus of the pressure generating chamber after jetting an ink drop. The initial and terminal voltages of the drive signal are equal to each other and equivalent to the standby voltage (VL) set as a voltage of the piezoelectric vibrator at the time of non-supply of the drive signal. The vibration damping voltage (VM) lies between the standby voltage VL and the maximum voltage VH of the drive signal. Accidental jetting of ink drops, at the time of recovery of the vibrator voltage using the voltage recovery device, can surely be prevented.

32 Claims, 9 Drawing Sheets

INK-JET RECORDING APPARATUS AND METHOD FOR DRIVING INK-JET RECORDING HEAD

BACKGROUND OF THE INVENTION

1. Field of the Invention

The present invention relates to an ink-jet recording apparatus for jetting ink drops from a nozzle opening by vibration of a piezoelectric-vibrator and printing on a recording paper or others, and a method for driving an ink-jet recording head thereof.

2. Description of the Related Art

Generally, an ink-jet recording apparatus has a recording head with many nozzle openings in the sub-scanning direction (the recording paper feeding direction). The recording head is moved in the main scanning direction (the direction of the recording paper width) by a carriage mechanism. Predetermined paper feeding is executed, and a desired printing result is obtained. On the basis of dot pattern data obtained by expanding print data input from a host computer, ink drops are jetted from each nozzle opening of the recording head respectively in predetermined timing. Each of the ink drops is jetted and adhered to a print recording medium of a recording paper or others, thereby dots are formed and printing is carried out.

The recording head mentioned above generally transfers deformation of a piezoelectric-vibrator to a vibration plate so as to contract a pressure generating chamber, increase the inner pressure, and jet ink drops from the nozzle openings. The aforementioned deformation of the piezoelectric-vibrator is obtained by changing a drive voltage input to the piezoelectric-vibrator. Therefore, ink drops are jetted by expanding and contracting the pressure generating chamber.

Each piezoelectric-vibrator used for the recording head of the ink-jet recording apparatus is assumed as an ideal capacitor from the viewpoint of design. Namely, the voltage (segment voltage) of the piezoelectric-vibrator is considered to continuously hold the voltage during the time of non-supply of the drive signal mentioned above. On the basis of this consideration, the drive signal is preset so as to keep the initial voltage and terminal voltage on the same level.

However, an actual piezoelectric-vibrator has an insulation resistance. Therefore, when it is left as it is with no drive signal supplied, it is found that the vibrator voltage gradually drops by natural discharge. The drop of the vibrator voltage, for example, is caused by non-uniformity of the piezo-electric body of the piezo-electric layer. Moreover, when the electrodes of the piezoelectric vibrator are short-circuited by a foreign substance existing between the electrodes, the drop of the vibrator voltage is caused.

Accordingly, a means for applying a voltage to the piezoelectric vibrator in the standby state with no drive signal applied (hereinafter referred to as a voltage recovery means) is proposed so as to recover the vibrator voltage dropped by discharge up to the intermediate voltage which is the standby voltage of the piezoelectric vibrator. For example, in Japanese Patent No. 3097155 (Japanese Patent Laid-Open Publication No. 4-310748, Japanese Patent Application No. 3-77718), a piezoelectric element charging means for compensating for a reduction in the charge due to discharge of the piezo-electric element by applying the charging voltage to the piezo-electric element in different timing from the print timing of the piezo-electric element is described.

Meanwhile, the drop amount of the vibrator voltage increases as the time from supply end of an earlier drive signal to supply start of a later drive signal, that is, the non-supply period of the drive signal becomes longer. Further, when the film thickness of the piezoelectric vibrator becomes thinner (as the electric field intensity becomes higher), the vibrator voltage drops remarkably. As a result, in a piezoelectric vibrator of a small volume (thin film thickness) requested recently, even if the non-supply period of the drive signal is very short, the difference between the vibrator voltage dropped due to discharge and the initial voltage of the later waveform element increases.

Furthermore, recently, to increase the height difference of the vibration damping waveform to be applied to the piezo-electric vibrator after ink drops are jetted, there is a tendency to set the intermediate voltage, which is the standby voltage, high. The drop amount of the vibrator voltage increases as the vibrator voltage increases. Therefore, as the intermediate voltage is set higher, the drop amount of the vibrator voltage increases.

As mentioned above, recently, the drop amount of the vibration voltage tends to increase. When the vibrator voltage is recovered by the voltage recovery means in a state that the vibrator voltage drops greatly, a problem arises that ink drops are accidentally jetted from the nozzle opening at the same time.

In the conventional ink-jet recording apparatus mentioned above, it is very difficult to include both the drive waveform for medium dots and the drive waveform of minute dots in the drive signal (COM) in one print cycle (one drive cycle). The reason is that the standby voltage suited to the drive waveform for medium dots and the standby voltage suited to the drive waveform for minute dots do not coincide with each other generally. When the standby voltage suited to the drive waveform for medium dots is fit to the standby voltage suited to the drive waveform for minute dots, the height difference of the drive waveform for medium dots itself becomes too large. As a result, a problem arises that at the time of jet of medium dots, air bubbles are apt to be taken into the nozzle opening. When air bubbles are taken into the nozzle opening like this, the inner pressure of the pressure generating chamber is not increased normally. As result, ink drops are not jetted normally, causing defective jet.

In the conventional ink-jet recording apparatus mentioned above, even if the ink viscosity is changed due to changing of the environmental temperature around the recording apparatus, ink drops are jetted by the same drive signal regardless of changing of the environment. Therefore, for example, when the ink viscosity is lowered due to a high-temperature environment or others, the meniscus is apt to become unstable and air bubbles are easily taken into the nozzle opening as mentioned above. Furthermore, when the operation environment of the recording apparatus is changed and the ink viscosity is changed, the jet characteristics are also changed and a problem arises that a fixed print quality cannot be easily obtained.

SUMMARY OF THE INVENTION

The present invention was developed with the foregoing in view and is intended to provide an ink-jet recording apparatus and a method for driving an ink-jet recording head thereof for surely preventing accidental ink drops at the time of recovery of the vibrator voltage by the voltage recovery means.

Another object of the present invention is to provide an ink-jet recording apparatus and a method for driving an inkjet recording head thereof for jetting ink drops without taking air bubbles into the nozzle opening.

Still another object of the present invention is to provide an ink-jet recording apparatus and a method for driving an ink-jet recording head thereof for preventing air bubbles from taking into the nozzle opening even if the environmental conditions around the recorder are changed.

According to the present invention, an ink-jet recording apparatus includes: a recording head having a piezoelectric vibrator for expanding and contracting a pressure generating chamber connected to a nozzle opening; and drive signal generator for generating a drive signal to be applied to said piezoelectric vibrator so as to drive said piezoelectric vibrator; wherein said drive signal includes an expansion waveform element for changing a voltage so as to expand said pressure generating chamber, a contraction waveform element for changing a voltage so as to contract said pressure generating chamber expanded by said expansion waveform element and jet an ink drop from said nozzle opening, and a vibration damping waveform element which changes from a terminal voltage of said contraction waveform element to a vibration damping voltage so as to expand said pressure generating chamber contracted by said contraction waveform element in order to suppress a residual vibration of a meniscus of said pressure generating chamber after jetting said ink drop, wherein an initial voltage and a terminal voltage of said drive signal are equal to each other and equivalent to a standby voltage which is set as a voltage of said piezoelectric vibrator at a time of non-supply of said drive signal, and wherein said vibration damping voltage lies between said standby voltage and a maximum voltage of said drive signal.

Preferably, said expansion waveform element includes a front part of waveform element, a back part of waveform element positioned behind said front part of waveform element, and a waveform element connection for connecting a terminal end of said front part of waveform element and a starting end of said back part of waveform element, wherein said waveform element connection is positioned at an intermediate voltage between said standby voltage and said maximum voltage, and wherein an inclination of said front part of waveform element is smaller than an inclination of said back part of waveform element.

Preferably, a difference between said standby voltage and said intermediate voltage is reduced in accordance with rising of an environmental temperature.

Preferably, a continuation time of said front part of waveform element is set longer than an intrinsic vibration cycle of said pressure generating chamber.

Preferably, said drive signal includes a return waveform element which is positioned behind said vibration damping waveform element and changes from said vibration damping voltage to said standby voltage.

Preferably, an inclination of said return waveform element is smaller than an inclination of said contraction waveform element.

Preferably, a continuation time of said return waveform element is set longer than said intrinsic vibration cycle of said pressure generating chamber.

Preferably, said standby voltage is a minimum voltage of said drive signal.

Preferably, a continuation time of said back part of waveform element is set longer than an intrinsic vibration cycle of said piezoelectric vibrator and shorter than said intrinsic vibration cycle of said pressure generating chamber.

Preferably, a continuation time of said contraction waveform element is set longer than an intrinsic vibration cycle of said piezoelectric vibrator.

Preferably, a continuation time of said vibration damping waveform element is set longer than an intrinsic vibration cycle of said piezoelectric vibrator.

Preferably, a contraction holding waveform element for holding a contraction condition of said pressure generating chamber contracted by said contraction waveform element succeeds said contraction waveform element and a total continuation time of said contraction waveform element and said contraction holding waveform element is set so as to be made practically equal to integer times of said intrinsic vibration cycle of said pressure generating chamber.

Preferably, said total continuation time of said contraction waveform element and said contraction holding waveform element is set so as to be made practically equal to said intrinsic vibration cycle of said pressure generating chamber.

Preferably, a voltage difference of said contraction waveform element itself is reduced in accordance with rising of an environmental temperature.

Preferably, a voltage difference of said vibration damping waveform element itself is increased in accordance with rising of an environmental temperature.

Preferably, an expansion holding waveform element for holding an expansion condition of said pressure generating chamber expanded by said expansion waveform element succeeds said expansion waveform element, and wherein a continuation time of said expansion holding waveform element is increased in accordance with rising of said environmental temperature.

According to the present invention, a method for driving an ink-jet recording head having a piezoelectric vibrator for expanding and contracting a pressure generating chamber connected to a nozzle opening, includes: a step of generating a drive signal to be applied to said piezoelectric vibrator so as to drive said piezoelectric vibrator; and a step of applying said drive signal to said piezoelectric vibrator and driving said piezoelectric vibrator; wherein said drive signal includes an expansion waveform element for changing a voltage so as to expand said pressure generating chamber, a contraction waveform element for changing a voltage so as to contract said pressure generating chamber expanded by said expansion waveform element and jet an ink drop from said nozzle opening, and a vibration damping waveform element for changing a voltage from a terminal voltage of said contraction waveform element to a vibration damping voltage so as to expand said pressure generating chamber contracted by said contraction waveform element in order to suppress a residual vibration of a meniscus of said pressure generating chamber after jetting said ink drop, wherein an initial voltage and a terminal voltage of said drive signal are equal to each other and equivalent to a standby voltage set as a voltage of said piezoelectric vibrator at a time of non-supply of said drive signal, and wherein said vibration damping voltage lies between said standby voltage and a maximum voltage of said drive signal.

Preferably, said expansion waveform element includes a front part of waveform element, a back part of waveform element positioned behind said front part of waveform element, and a waveform element connection for connecting a terminal end of said front part of waveform element and a starting end of said back part of waveform element, wherein said waveform element connection is positioned at an intermediate voltage between said standby voltage and said maximum voltage, and wherein an inclination of said front part of waveform element is smaller than an inclination of said back part of waveform element.

Preferably, a difference between said standby voltage and said intermediate voltage is reduced in accordance with rising of an environmental temperature.

Preferably, a continuation time of said front part of waveform element is set longer than an intrinsic vibration cycle of said pressure generating chamber.

Preferably, said drive signal includes a return waveform element which is positioned behind said vibration damping waveform element and changes from said vibration damping voltage to said standby voltage.

Preferably, an inclination of said return waveform element is smaller than an inclination of said contraction waveform element.

Preferably, a continuation time of said return waveform element is set longer than said intrinsic vibration cycle of said pressure generating chamber.

Preferably, said standby voltage is a minimum voltage of said drive signal.

Preferably, a continuation time of said back part of waveform element is set longer than an intrinsic vibration cycle of said piezoelectric vibrator and shorter than said intrinsic vibration cycle of said pressure generating chamber.

Preferably, a continuation time of said contraction waveform element is set longer than said intrinsic vibration cycle of said piezoelectric vibrator.

Preferably, a continuation time of said vibration damping waveform element is set longer than said intrinsic vibration cycle of said piezoelectric vibrator.

Preferably, a contraction holding waveform element for holding a contraction condition of said pressure generating chamber contracted by said contraction waveform element succeeds said contraction waveform element, and wherein a total continuation time of said contraction waveform element and said contraction holding waveform element is set so as to be made practically equal to integer times of said intrinsic vibration cycle of said pressure generating chamber.

Preferably, said total continuation time of said contraction waveform element and said contraction holding waveform element is set so as to be made practically equal to said intrinsic vibration cycle of said pressure generating chamber.

Preferably, a voltage difference of said contraction waveform element itself is reduced in accordance with rising of an environmental temperature.

Preferably, a voltage difference of said vibration damping waveform element itself is increased in accordance with rising of an environmental temperature.

Preferably, an expansion holding waveform element for holding an expansion condition of said pressure generating chamber expanded by said expansion waveform element succeeds said expansion waveform element, and wherein a continuation time of said expansion holding waveform element is increased in accordance with rising of an environmental temperature.

BRIEF DESCRIPTION OF THE DRAWINGS

FIG. 6A is an illustration showing a drive signal, and FIG. 6B is a drawing showing dots to be formed.

DESCRIPTION OF THE PREFERRED EMBODIMENTS

Figure 1:
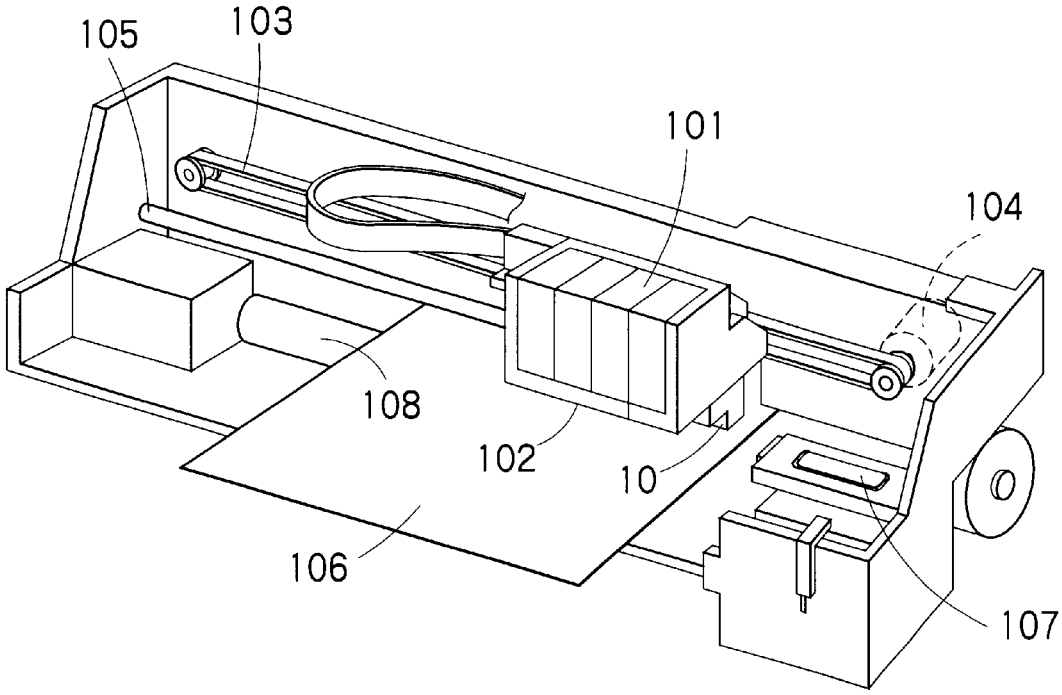
FIG. 1 is a perspective view showing the rough constitution of the ink-jet recording apparatus of the first embodiment of the present invention.

FIG. 1 is a drawing showing the structure of an ink-jet recording apparatus of the first embodiment of the present invention. The recorder has a carriage 102 in which an ink cartridge 101 is loaded on the upper part.

The carriage 102 is connected to a stepping motor 104 via a timing belt 103 and moves back and forth in the direction of the paper width (main scanning direction) of a recording paper 106 under guidance of a guide bar 105. To the surface (the bottom in this example) of the carriage 102 opposite to the recording paper 106, a recording head 10 is attached. Ink is fed to the recording head 10 from the ink cartridge 101, and the recording head 10 jets ink drops on the top of the recording paper 106 during moving, and prints an image and characters on the recording paper 106 by a dot matrix.

In FIG. 1, numeral 107 indicates a cap for sealing the nozzle opening of the recording head 10 during print stop or others and preventing the nozzle opening from drying as far as possible, and numeral 108 indicates a paper feed roller for feeding a recording paper.

Figure 2:
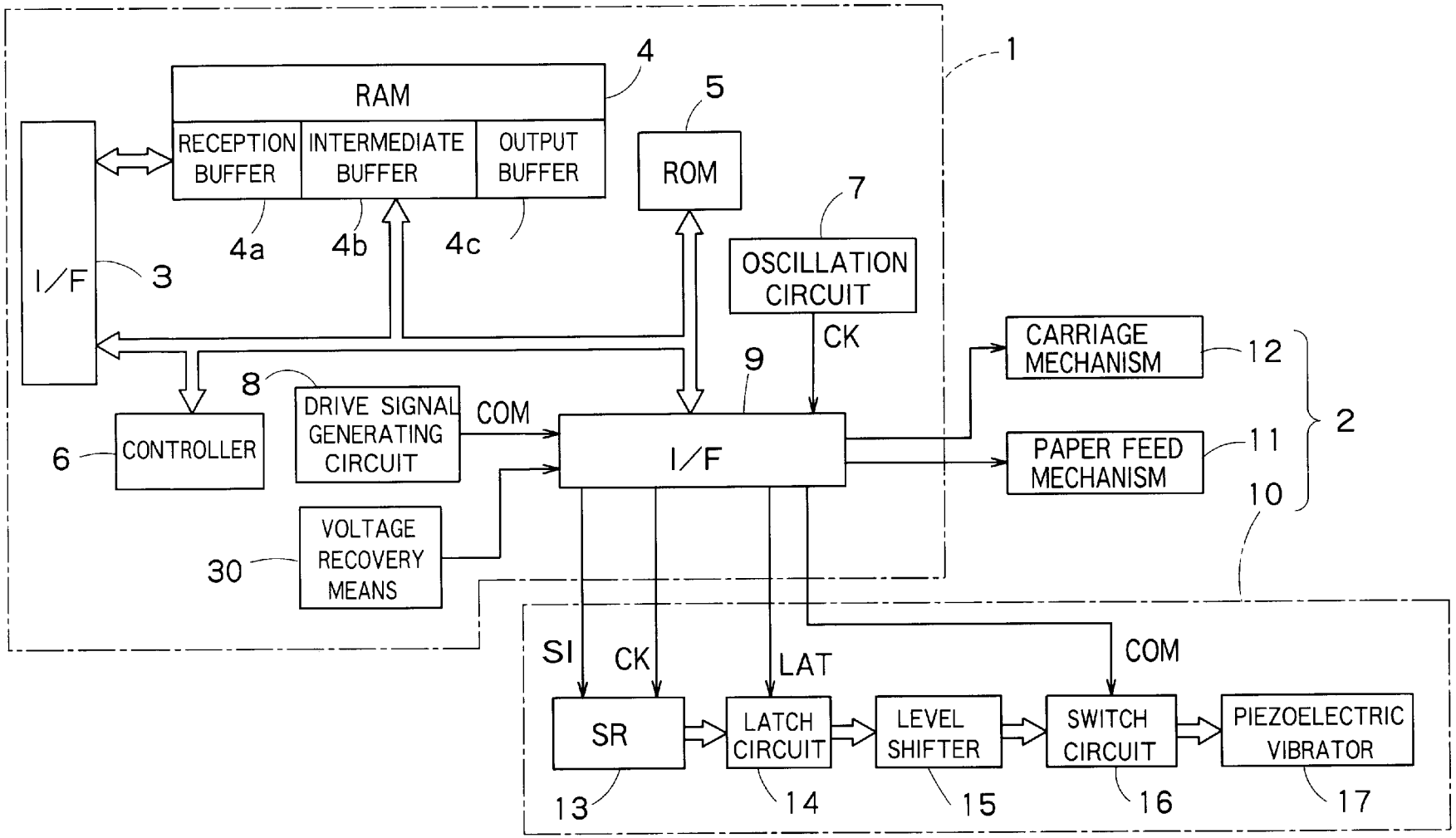
FIG. 2 is a constitution explanatory diagram showing the whole constitution of the ink-jet recording apparatus of the first embodiment of the present invention.

FIG. 2 is a function block diagram of the ink-jet recording apparatus of the first embodiment of the present invention. The ink-jet recording apparatus is composed of a printer controller 1 and a print engine 2. The printer controller 1 has an interface (hereinafter abbreviated to I/F) 3 for receiving print data or others from a host computer (not shown in the drawing) or others, a RAM 4 for storing various data, a ROM 5 for storing a routine for processing various data or others, a controller 6 composed of a CPU or others, an oscillation circuit 7, a drive signal generation circuit (drive signal generator) 8 for generating a drive signal to be supplied to the recording head 10 which will be described later, and an I/F 9 for transmitting print data expanded to dot pattern data (bit map data) and a drive signal to the print engine 2.

The I/F 3 aforementioned receives print data composed of, for example, any one of a character code, a graphic function, and image data or a plurality of data from the host computer. The I/F 3 can output a busy signal (BUSY), an acknowledge signal (ACK), or others to the host computer.

The RAM 4 aforementioned is used as a reception buffer 4*a*, an intermediate buffer 4*b*, an output buffer 4*c*, and a power memory (not shown in the drawing). The reception buffer 4*a* temporarily stores print data from the host computer which is received by the I/F 3. The intermediate buffer 4*b* stores intermediate code data converted to an intermediate code by the controller 6. The output buffer 4*c* expands dot pattern data obtained by decoding gradation data. The ROM 5 aforementioned stores various control routines to be executed by the controller 6, font data, a graphic function, and various procedures.

The controller 6 reads print data stored in the reception buffer 4*a*, converts it to an intermediate code, and memorizes the intermediate code data in the intermediate buffer 4*b*. Next, the controller 6 analyzes the intermediate code data read from the intermediate buffer 4*b*, refers to the font data, graphic function, and others stored in the ROM 5, and expands the intermediate code data to dot pattern data. The expanded dot pattern data is subjected to a necessary decorative process and then stored in the output buffer 4*c*.

When dot pattern data equivalent to one line of the recording head 10 is obtained, the dot pattern data in correspondence to one line is transmitted serially to the recording head 10 via the I/F 9. When the dot pattern data in correspondence to one line is output from the output buffer 4*c*, the contents of the intermediate buffer 4*b* are erased and the next intermediate code conversion is performed.

The print engine 2 has the recording head 10, a paper feed mechanism 11, and a carriage mechanism 12. The paper feed mechanism 11 is composed of a paper feed motor and paper feed rollers, sequentially feeds print storage media such as recording papers, and performs sub-scanning for them. The carriage mechanism 12 is composed of a carriage for loading the recording head 10 and a carriage motor for moving the carriage via a timing belt and allows the recording head 10 to perform main scanning.

The recording head 10 has many nozzle openings (for example, 96 each) in the sub-scanning direction and jets ink drops from each nozzle opening in predetermined timing. Print data expanded to dot pattern data is transmitted serially from the I/F 9 to a shift register 13 in synchronization with a clock signal (CK) from the oscillation circuit 7. The print data (SI) serially transmitted is latched by a latch circuit 14 once. The latched print data is increased in voltage to a voltage for driving a switch circuit 16, for example, a predetermined voltage of about several tens volt by a level shifter 15 which is a voltage amplifier. The print data increased to the predetermined voltage is given to the switch circuit 16. A drive signal (COM) from the drive signal generation circuit 8 is applied to the input side of the switch circuit 16 and a piezoelectric vibrator 17 is connected to the output side of the switch circuit 16.

The print data controls the operation of the switch circuit 16. For example, during a period that print data applied to the switch circuit 16 is "1", a drive signal is input to the piezoelectric vibrator 17, and the piezoelectric vibrator 17 expands and contracts according to the drive signal. On the other hand, during a period that print data applied to the switch circuit 16 is "0", the supply of the drive signal to the piezoelectric vibrator 17 is interrupted and the piezoelectric vibrator 17 holds the preceding charge, thereby the preceding displacement condition is held.

When no drive signal is applied to the piezoelectric vibrator 17, as shown by a dashed line in FIG. 4 which will be explained in detail later, the voltage of the piezoelectric vibrator 17 drops slowly by discharge. Therefore, in this embodiment, a voltage recovery means 30 (FIG. 2) for recovering the voltage of the piezoelectric vibrator 17 dropped by discharge up to the standby voltage which is preset as a voltage of the piezoelectric vibrator at the time of no supply of the drive signal is installed.

Next, the recording head 10 will be explained in detail.

Figure 3:
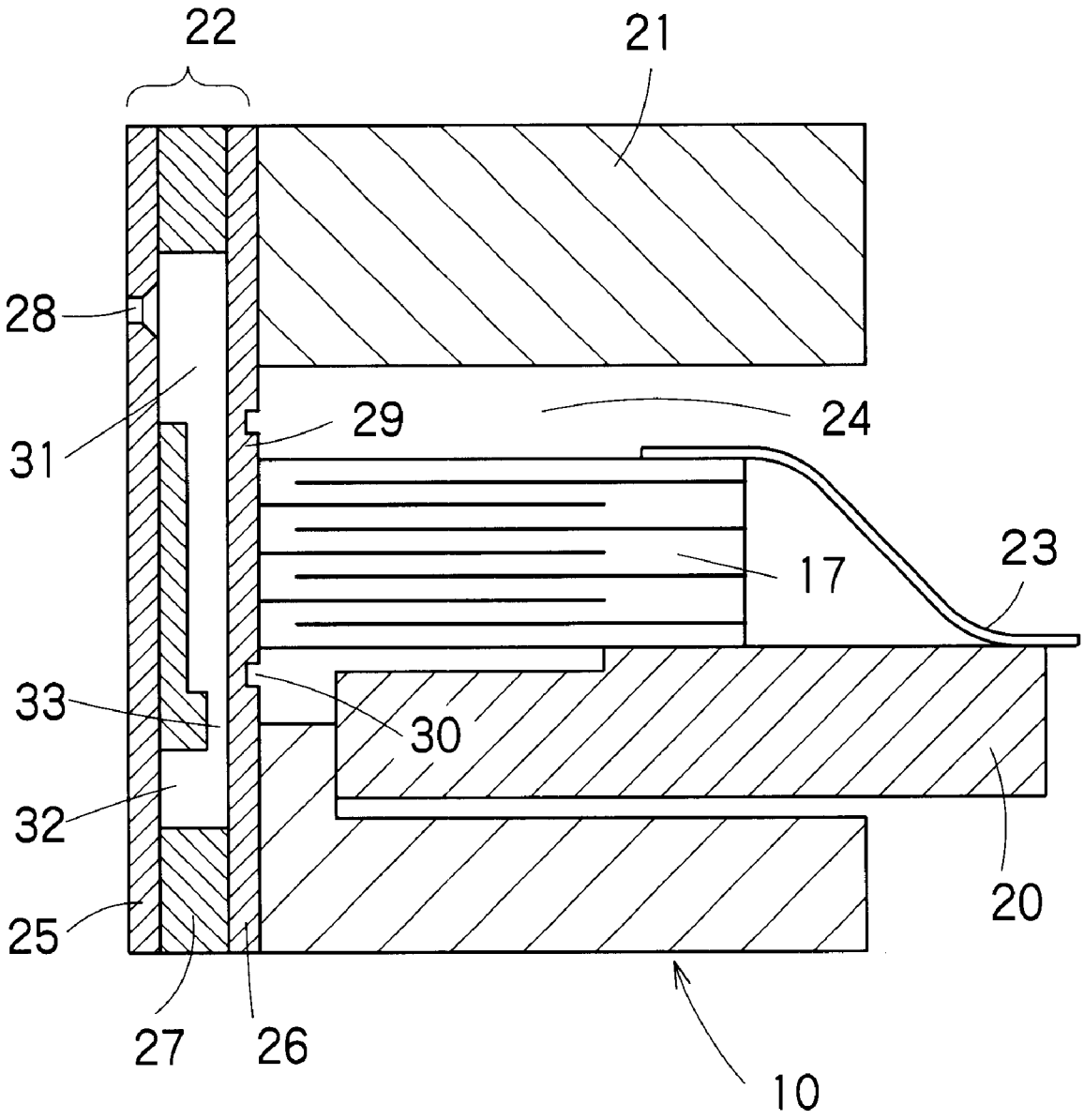
FIG. 3 is a cross sectional view showing the mechanical structure of the recording head of the ink-jet recording apparatus of the first embodiment of the present invention.

As the recording head 10, the recording head 10 to which the piezoelectric vibrator 17 in the longitudinal vibration mode is attached is used. The recording head 10, as shown in FIG. 3, has a frame 21 made of synthetic resin and a flow path unit 22 adhered to the front (the left side of the drawing) of the frame 21. The flow path unit 22 is composed of a nozzle plate 25 having a bored nozzle opening 28, a vibration plate 26, and a flow path forming plate 27.

The frame 21 is a block-shaped member having a storage space 24 opened on the front and back. In the storage space 24, the piezoelectric vibrator 17 fixed to a fixing substrate 20 is stored.

The nozzle plate 25 is a thin laminar member having many nozzle openings 28 bored along the sub-scanning direction. Each nozzle opening 28 is formed at a predetermined pitch corresponding to the dot forming density. The vibration plate 26 is a laminar member having a thick island portion 29 with which the piezoelectric vibrator 17 is in contact and thin elastic portions 30 installed so as to enclose the periphery of the island portion 29. Many island portions 29 are installed at a predetermined pitch so that one island portion 29 corresponds to one nozzle opening 28.

In the flow path forming plate 27, a pressure generating chamber 31, an ink chamber 32, and an opening for forming an ink feed path 33 for connecting the pressure generating chamber 31 and the ink chamber 32 are installed. The nozzle plate 25 is arranged on the front of the flow path forming plate 27, and the vibration plate 26 is arranged on the back thereof, and the flow path unit 22 is integrated and formed by adhesion in the state that the flow path forming plate 27 is interposed between the nozzle plate 25 and the vibration plate 26.

In the flow path unit 22, the pressure generating chamber 31 is formed on the back side of the nozzle opening 28, and the island portion 29 of the vibration plate 26 is positioned on the back side of the pressure generating chamber 31. The pressure generating chamber 31 and the ink chamber 32 are connected by the ink feed path 33.

The end of the piezoelectric vibrator 17 is in contact with the back side of the island portion 29 and the piezoelectric vibrator 17 is fixed to the frame 21 in this contact state. To the piezoelectric vibrator 17, a drive signal (COM) and print data (SI) are supplied via a flexible cable 23.

The piezoelectric vibrator 17 is designed so as to contract when it is charged and expand when it is discharged. Therefore, in the recording head 10 having the aforementioned constitution, the piezoelectric vibrator 17 contracts when it is charged, and the island portion 29 is pulled backward in correspondence with the contraction of the piezoelectric vibrator 17 so that the pressure generating chamber 31 expands. In correspondence with this expansion, ink in the ink chamber 32 is fed into the pressure generating chamber 31 via the ink feed path 33. On the other hand, the piezoelectric vibrator 17 expands forward when it is discharged, and the island portion 29 of the elastic plate is pressed forward so that the pressure generating chamber 31 contracts. In correspondence with this contraction, the ink pressure in the pressure generating chamber 31 increases and an ink drop is jetted from the nozzle opening 28.

Next, control of the recording head 10 will be explained.

Figure 4:
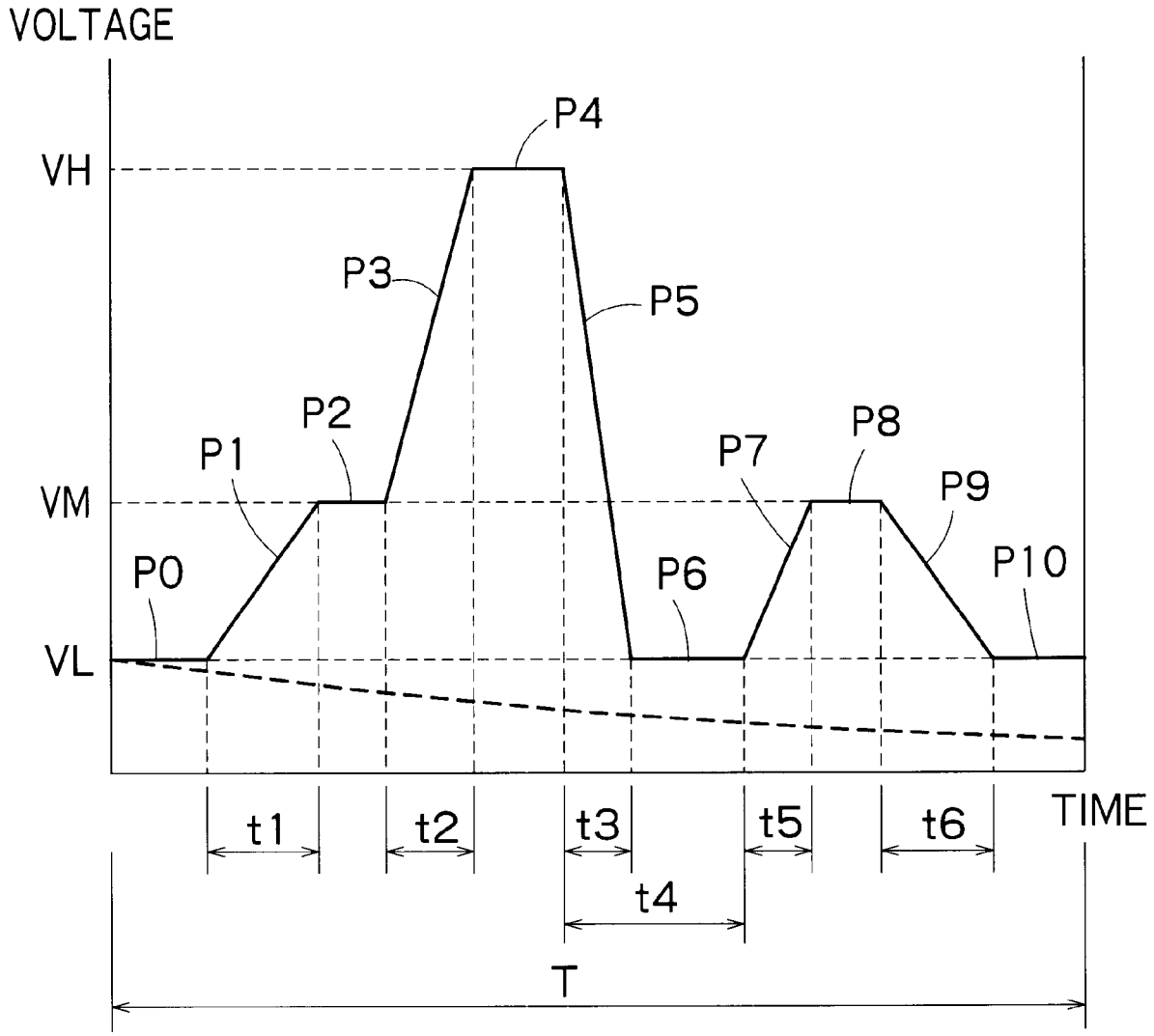
FIG. 4 is an illustration showing a drive signal of the recording head used in the first embodiment of the present invention.

FIG. 4 is a drawing showing a drive signal in one print cycle (one drive cycle) T generated by the drive signal generation circuit 8. In the drive signal, both the initial voltage at the signal start point (P0) and the terminal voltage at the signal end point (P10) are set to the minimum drive voltage VL. The drive signal is formed by changing the voltage level in the range between the minimum drive voltage VL and the maximum drive voltage VH.

The drive signal aforementioned has a signal (P1, P2: preparatory signal) for slightly expanding the pressure generating chamber 31 by increasing the voltage from the minimum drive voltage VL to the intermediate voltage (intermediate drive voltage) VM between the maximum drive voltage VH and the minimum drive voltage VL and holding the pressure generating chamber 31 in the state for a given period of time by keeping the intermediate drive voltage VM, a signal (P3, P4: expansion signal) for increasing the voltage from the intermediate drive voltage VM to the maximum drive voltage VH, pulling in the meniscus by expanding the pressure generating chamber 31, and holding the pressure generating chamber 31 in the state for a given period of time by keeping the maximum drive voltage VH, and a signal (P5, P6: jet signal) for contracting the pressure generating chamber 31 by dropping the voltage down to the minimum drive voltage VL to jet an ink drop and holding a contracted state of the pressure generating chamber 31 by keeping the minimum drive voltage VL for a given period of time. P1, P2, and P3 constitute the expansion waveform element of the present invention.

The drive signal aforementioned has a signal (P7: vibration damping signal) constituting a vibration damping waveform element for damping the residual vibration of the meniscus by expanding the pressure generating chamber 31 by increasing the voltage up to the intermediate drive voltage VM again after jetting an ink drop and a signal (P8, P9: return signal) including a return waveform element (P9) for keeping the voltage at the intermediate drive voltage VM for a given period of time after vibration damping of the meniscus, then dropping it down to the minimum drive voltage VL comparatively slowly, contracting the pressure generating chamber 31, and returning the pressure generating chamber 31 to the standby state. Here, the meniscus means a curved free surface of ink exposed in the nozzle opening 28.

In this embodiment, the voltage at the waveform element connection (P2) of the preparatory signal (P1, P2) is set so as to be equal to the vibration damping voltage (voltage of P8) which is the terminal voltage of the vibration damping waveform element (P7). However, the voltage at the waveform element connection (P2) can be set higher or lower than the vibration damping voltage.

Figure 5A:
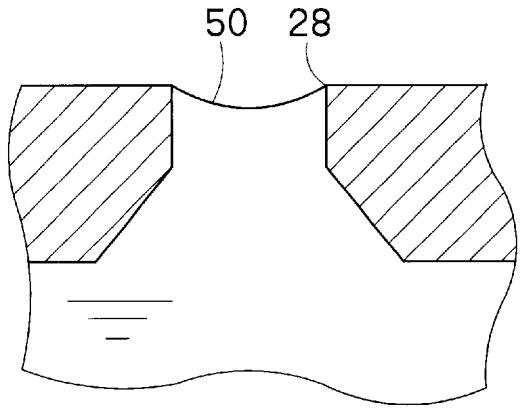
FIGS. 5A, 5B, 5C and 5D are illustrations showing the behavior of the meniscus by the method for driving the recording head in the first embodiment of the present invention.
Figure 5B:
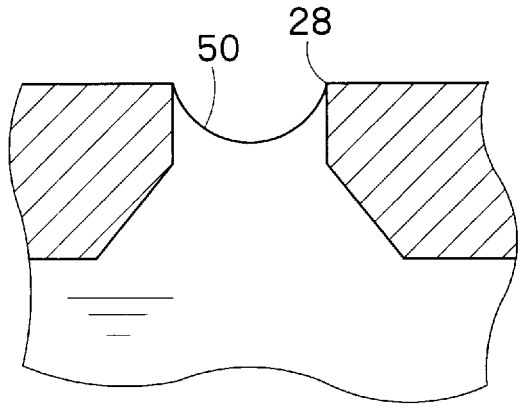
Figure 5C:
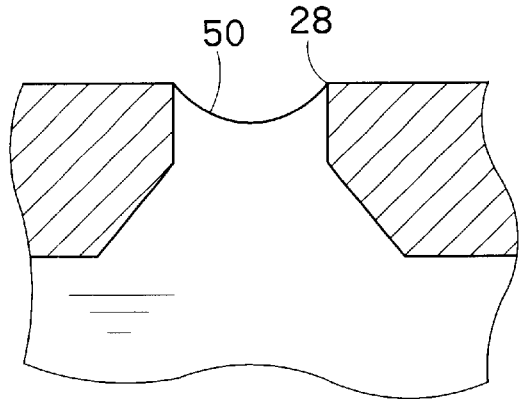

When the drive signal aforementioned is input to the piezoelectric vibrator 17 so as to contract and expand the piezoelectric vibrator 17, the pressure generating chamber 31 expands and contracts and an ink drop is jetted. Namely, firstly, in the standby state (P0), as shown in FIG. 5A, a meniscus 50 stays in the position of the opening edge of the nozzle opening 28. When the preparatory signal (P1, P2) is input from the standby state (P0), the piezoelectric vibrator 17 contracts, and the pressure generating chamber 31 slightly expands, and as shown in FIG. 5B, the meniscus 50 is slightly pulled in from the nozzle opening 28. Next, when the pressure generating chamber 31 is held for a given period of time, as shown in FIG. 5C, the meniscus 50 pulled in returns slightly forward.

Figure 5D:
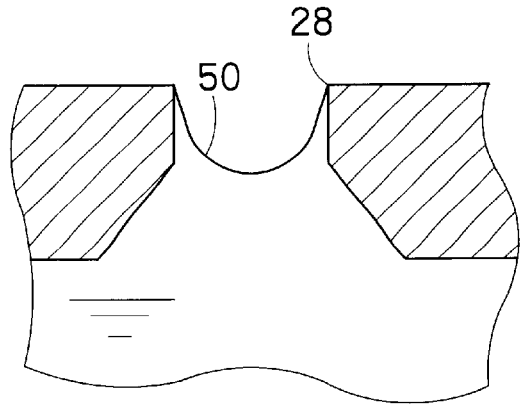

Next, when the expansion signal (P3, P4) is input, the piezoelectric vibrator 17 contracts, and the pressure generating chamber 31 expands additionally, and as shown in FIG. 5D, the meniscus 50 is pulled in. In this case, the pressure generating chamber 31 is expanded to a certain extent beforehand by the preparatory signal (P1, P2), so that the meniscus 50 is not pulled in largely so much. When the jet signal (P5, P6) including the contraction waveform element (P5) is input, the piezoelectric vibrator 17 expands and the pressure generating chamber 31 suddenly contracts. By this contraction of the pressure generating chamber 31, the inner pressure of the pressure generating chamber 31 increases and ink in the neighborhood of the nozzle opening 28 is jetted as an ink drop. In this case, since the meniscus 50 pulls in little before jet, air bubbles are prevented from taking into the nozzle opening 28.

Next, when the vibration damping waveform element (P7) is input, the piezoelectric vibrator 17 contracts, and the pressure generating chamber 31 expands, and the meniscus 50, which is apt to eject forward by jet, is pulled back, and the residual vibration of the meniscus 50 is damped. By doing this, the residual vibration of the meniscus is suppressed and the vibration of the meniscus is converged. Therefore, when ink drops are jetted successively, the successive jet operation can be performed after the meniscus becomes stable condition. As a result, variations in the volume of ink drops are reduced, and a stable print quality can be ensured.

When the return signal (P8, P9) including the return waveform element (P9) is input, the piezoelectric vibrator 17 expands and the pressure generating chamber 31 contracts until it is reduced to the same volume as that in the standby state (P0) at a comparatively slow speed such that an ink drop is not jetted. When the return signal (P8, P9) for returning the pressure generating chamber 31 to the standby state after output of the vibration damping waveform element (P7) like this is provided, the voltage at the start point of the drive signal and that at the end point are made equal to each other, so that there is no need to supply an unnecessary signal to return the voltage at the time of continuous generation of the drive signal.

In the drive signal aforementioned, it is preferable to set the continuation time (T1) of the front waveform element (P1) constituting a part of the preparatory signal (P1, P2) equal to or more than the intrinsic vibration cycle Tc of the pressure generating chamber 31. By doing this, the vibration of the meniscus 50 generated when the pressure generating chamber 31 expands by input of the front waveform element (P1) is suppressed low. As a result, when the back waveform element (P3) is input continuously, air bubbles are prevented from taking into the nozzle opening 28 at the time of expansion of the pressure generating chamber 31.

Further, in the drive signal aforementioned, it is preferable to set the continuation time (t2) of the back waveform element (P3) to the intrinsic vibration cycle Ta of the piezoelectric vibrator 17 or more and to the intrinsic vibration cycle Tc of the pressure generating chamber 31 or less. The reason is that by doing this, an ink drop of a suitable ink weight can be jetted at a suitable jet speed without increasing the maximum drive voltage VH so high.

Further, in the drive signal aforementioned, among the jet signals (P5, P6) aforementioned, it is preferable to set the continuation time (t3) of the contraction waveform element (P5) for contracting the pressure generating chamber 31 to the intrinsic vibration cycle Ta of the piezoelectric vibrator 17 or more. The reason is that by doing this, the occurrence of residual vibration of the vibration plate 29 is prevented after jet and unnecessary ink jet regardless of the print signal can be prevented.

Further, in the drive signal aforementioned, it is preferable to set the continuation time (t5) of the vibration damping waveform element (P7) to the intrinsic vibration cycle Ta of the piezoelectric vibrator 17 or more. It is preferable to set the continuation time (t4) of the jet signal (P5, P6) so as to be made practically equal to integer times of the intrinsic vibration cycle Tc of the pressure generating chamber 31. Furthermore, it is preferable to set the continuation time (t4) of the jet signal (P5, P6) aforementioned so as to be practically equal to the intrinsic vibration cycle Tc of the pressure generating chamber 31. The reason is that by doing this, the timing for expanding the pressure generating chamber 31 by the vibration damping waveform element (P7) is close to an almost opposite phase of that of the residual vibration of the meniscus 50 after jet, so that the residual vibration of the meniscus 50 can be suppressed more effectively. Therefore, when ink drops are jetted successively, the successive jet operation can be performed after the meniscus becomes stable condition. As a result, variations in the volume of ink drops are reduced, and a stable print quality can be ensured.

Further, in the drive signal aforementioned, it is preferable to set the continuation time (t6) of the return waveform element (P9) of the return signal (P8, P9) to the intrinsic vibration cycle Tc of the pressure generating chamber 31 or more. The reason is that by doing this, after the residual vibration of the meniscus 50 is damped by the vibration damping waveform element (P7), the pressure generating chamber 31 can be returned to the standby state with the meniscus 50 oscillating little. Therefore, at the time of continuous jet of ink drops, the next jet operation can be performed without vibrating the meniscus and a stable print quality can be ensured free of variations in the volume of ink drops.

In this case, the intrinsic vibration cycle Ta of the piezoelectric vibrator 17 can be expressed by the formula (1) indicated below.

$$1/Ta=1/(2\,L)\sqrt{(E/\rho)} \tag{1}$$

where

L: free end length of piezoelectric vibrator,

E: Young's modulus of elasticity, and

ρ: specific gravity of piezoelectric vibrator.

The intrinsic vibration cycle Tc of the pressure generating chamber 31 can be expressed by the formula (2) indicated below.

$$Tc=2\sqrt{(Cc\cdot Mn\cdot Ms/(Mn+Ms))} \tag{2}$$

where

Mn: inertance of nozzle opening,

Ms: inertance of ink feed path, and

Cc: compliance of pressure generating chamber.

As mentioned above, according to this embodiment, the initial voltage and terminal voltage (VL) of the drive signal equivalent to the standby voltage of the piezoelectric vibrator 17 are set lower than the conventional standby voltage (initial and terminal voltage) of the drive waveform, so that the voltage difference at the time of recovery of the vibrator voltage dropped by discharge up to the standby voltage by the voltage recovery means 30 is lower than the conventional one. Therefore, at the time of recovery of the vibrator voltage up to the standby voltage, ink drops can be surely prevented from accidentally jetting.

Further, according to this embodiment, when the preparatory signal (P1, P2) including the front waveform element (P1) for expanding the pressure generating chamber 31 in the standby state within the range smaller than the expansion amount by the expansion signal (P3, P4) is provided before outputting the expansion signal (P3, P4) including the back waveform element (P3), air bubbles are prevented from taking in the nozzle opening 28 and an occurrence of defective jet is prevented. Further, since the vibration damping waveform element (P7) having the timing and continuation time so as to effectively suppress the residual vibration of the meniscus 50 after outputting the jet signal (P5, P6) including the jet waveform element (P5) is provided, at the time of suppressing the residual vibration of the meniscus 50 and continuous jet of ink drops, the vibration of the meniscus 50 is sufficiently converged before the next jet operation is performed. As a result, variations in the volume of ink drops are reduced, and a stable print quality can be ensured.

Furthermore, since the return signal (P8, P9) including the return waveform element (P9) for returning the pressure generating chamber 31 to the standby state after outputting the vibration damping waveform element (P7) is provided, the voltage at the start point of the drive signal and the voltage at the end point of the same are equal to each other and at the time of continuous generation of the drive signal, there is no need to supply an unnecessary signal for returning the voltage. Moreover, since the voltage in the standby state (standby voltage) is the minimum drive voltage VL, it is possible to set the minimum drive voltage VL to the ground voltage so that the control becomes easy.

Figure 6A:
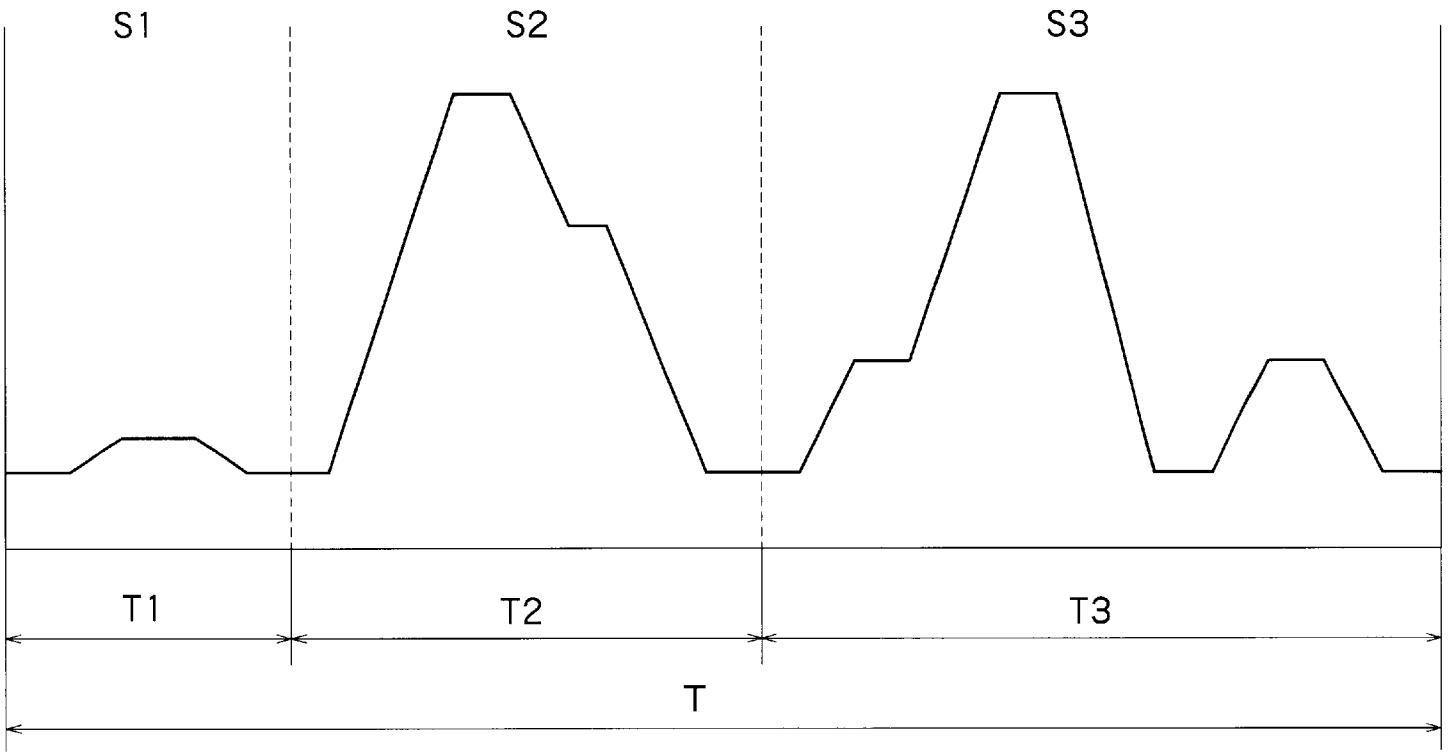
FIGS. 6A and 6B are drawings for explaining the second embodiment of the present invention.

FIG. 6A is a drawing showing the drive signal of the second embodiment of the present invention. In the drive signal of this embodiment, in one print cycle (one drive cycle) T, in addition to the drive waveform S3 in the same waveform as that of the drive signal shown in FIG. 4, two drive waveforms S1 and S2 exist. And, the three drive waveforms S1 to S3 aforementioned are selectively used.

The drive waveform S1 is a minute vibration drive waveform for increasing the voltage up to a voltage such that it jets no ink drops from the minimum drive voltage VL and returning it down to the minimum drive voltage VL again. By inputting the minute vibration drive waveform S1, the meniscus 50 of the nozzle opening 28 in the standby state vibrates minutely without jetting ink drops, diffuses ink increased in viscosity in the neighborhood of the nozzle opening 28, and reduces the viscosity.

The drive waveform S2 is a drive waveform for minute dots for increasing the voltage from the minimum drive voltage VL to the maximum drive voltage VH, holding it for a predetermined period, pulling in the meniscus 50 greatly, dropping the voltage from the maximum drive voltage VH to an almost intermediate voltage between VL and VH, holding it for a predetermined time, jetting ink drops, returning the voltage to the minimum drive voltage VL again, thereby jetting minute ink drops.

In this recording apparatus, for example, when the minute vibration operation is to be performed, the switch circuit 16 is connected only in the period T1, and only the drive signal S1 is used, and the minute vibration operation is performed. To form a minute dot, the switch circuit 16 is connected only in the period T2, and only the drive signal S2 is used, and an ink drop for minute dot is jetted. To form a medium dot relatively larger than the minute dot, the switch circuit 16 is connected only in the period T3, and only the drive signal S3 is used, and an ink drop for medium dot is jetted.

Furthermore, to form a large dot relatively larger than a medium dot, the switch circuit 16 is connected in the periods T2 and T3, and the drive signals S2+S3 are used, and a large dot is formed by two ink drops.

Figure 6B:
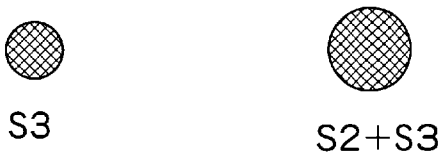

By doing this, by one kind of drive signal, as shown in FIG. 6B, three-step dots different in size can be formed and clogging can be eliminated to a certain degree by the minute vibration operation. The others are the same as those of the first embodiment aforementioned and the same operations and effects can be produced.

Next, the ink-jet recording apparatus and the method for driving the recording head thereof in the third embodiment of the present invention will be explained by referring to the drawings.

Figure 7:
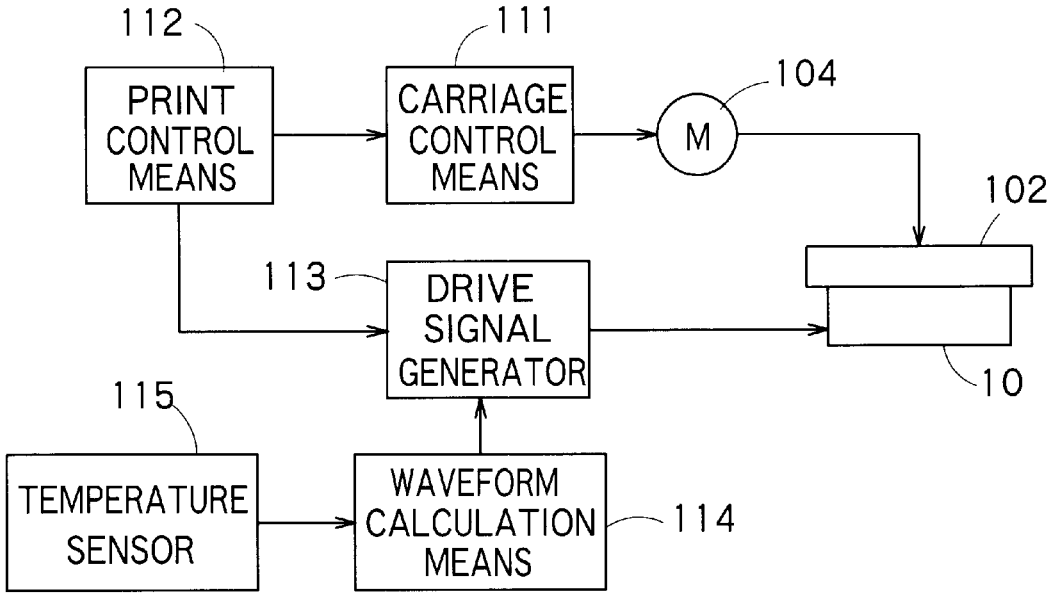
FIG. 7 is a system block diagram of the ink-jet recording apparatus of the third embodiment of the present invention.

The ink-jet recording apparatus of this embodiment, as shown in FIG. 7, has a temperature sensor 115 for measuring the environmental temperature around the recording apparatus, a waveform calculation means 114 for calculating and obtaining the waveform of a drive signal corresponding to the environmental temperature measured by the temperature sensor 115, and a drive signal generator 113 for generating a drive signal in the waveform calculated by the waveform calculation means 114. And, the recording apparatus changes the waveform of the drive signal aforementioned according to the environmental temperature around the recording apparatus. In FIG. 7, numeral 112 indicates a print control means for preparing bit map data on the basis of a print signal from the host computer and numeral 111 indicates a carriage control means for controlling back and forth scanning of the carriage 102.

Figure 8:
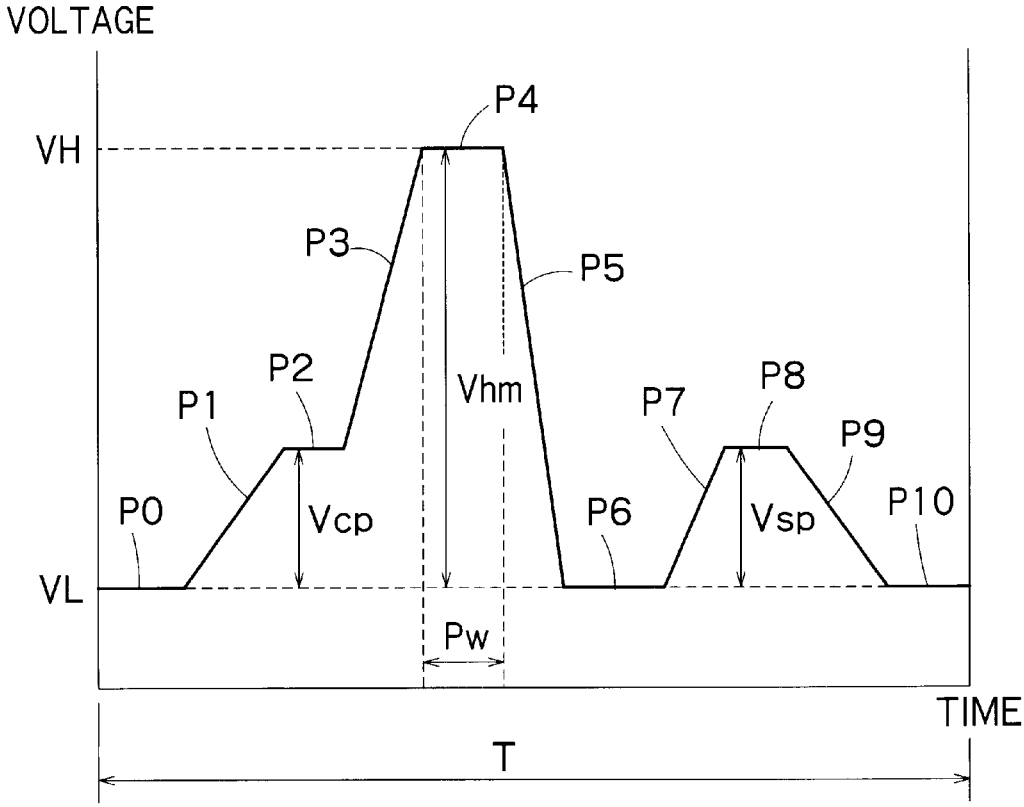
FIG. 8 is an illustration showing a drive signal used in the third embodiment of the present invention.

FIG. 8 shows the drive signal used in this embodiment. Among the waveforms of the drive signal shown in FIG. 8, the voltage difference (Vhm) at the contraction waveform element (P5) of the jet signal (P5, P6), the voltage difference (Vcp) at the front waveform element (P1) of the preparatory signal (P1, P2), the voltage difference (Vsp) at the vibration damping waveform element (P7), and the voltage holding time (Pw) at the expansion holding waveform element (P4) of the expansion signal (P3, P4) are changed respectively according to the environmental temperature.

As explained more in detail, it is preferable that the voltage difference (Vhm) of the contraction waveform element (P5), for example, as shown in Table 1 indicated below, reduces as the environmental temperature T rises. When the environmental temperature T rises and the ink viscosity lowers, and the meniscus 50 (FIG. 5A) becomes unstable and air bubbles can be easily taken in, by reducing the voltage difference (Vhm) at the contraction waveform element (P5), air bubbles are prevented from taking in. Further, when the environmental temperature T lowers and the ink viscosity increases, and the meniscus 50 hardly ejects, the voltage difference (Vhm) at the contraction waveform element (P5) is increased and the meniscus 50 is pressed out largely to a certain extent so that a fixed print quality can be kept. In Table 1, Vhm25 indicates Vhm when the environmental temperature T is 25° C. and in this example, it is set at 23V.

TABLE 1

Vhm25: Vhm at 25° C. (23 V)

| Temperature range | Voltage difference of jet signal (Vhm) |
|---|---|
| T < 15° C. | Vhm25 + {Vhm25 × 0.0055} |
| 15° C. ≦ T ≦ 25° C. | Vhm25 + {Vhm25 × 0.0055 × (T-25)/(15-25)} |
| 25° C. ≦ T ≦ 40° C. | Vhm25 − {Vhm25 × 0.0066 × (T-25)/(40-25)} |
| 40° C. < T | Vhm25 − {Vhm25 × 0.0066} |

It is preferable that the voltage difference (vcp) at the front waveform element (P1) of the preparatory signal (P1, P2), for example, as shown in Table 2 indicated below, reduces as the environmental temperature T rises. By doing this, when the environmental temperature T rises and the ink viscosity lowers, and the meniscus 50 is easily pulled in and air bubbles are easily taken in, by reducing the voltage difference (vcp) at the front waveform element (P1), air bubbles are prevented from taking in. Further, when the environmental temperature T lowers and the ink viscosity increases, and the meniscus 50 is hardly pulled in, since the voltage difference (Vcp) at the front waveform element (P1) is increased and the meniscus 50 is pulled in to a certain extent, a fixed print quality can be kept.

TABLE 2

(Unit: %, percentage to Vhm)

| Temperature range | Voltage difference of preparatory signal (Vcp) |
|---|---|
| T < 15° C. | 40 |
| 15° C. ≦ T ≦ 25° C. | 45-5 × (T-25)/(15-25) |
| 25° C. ≦ T ≦ 40° C. | 50-15 × (T-40)/(25-40) |
| 40° C. < T | 50 |

When changing the voltage difference (Vcp) at the front waveform element (P1), the voltage of the waveform element connection (P2) may be changed or the voltage (initial voltage) in the standby state may be changed. When changing the voltage (initial voltage) in the standby state (P0), the voltage (terminal voltage) at the end point (P10) of the drive signal is changed in the same way so as to make the initial voltage and terminal voltage equal to each other.

It is preferable that the voltage difference (Vsp) at the vibration damping waveform element (P7), for example, as shown in Table 3 indicated below, increases as the environmental temperature T rises. By doing this, when the environmental temperature T rises and the ink viscosity lowers, and the meniscus 50 easily vibrates and the residual vibration also increases, by increasing the voltage difference (Vsp) at the vibration damping waveform element (P7), the residual vibration can be damped effectively. Further, when the environmental temperature T lowers and the ink viscosity increases, and the meniscus 50 hardly vibrates, since the voltage difference (Vsp) at the vibration damping waveform element (P7) is reduced, the residual vibration is effectively damped and the meniscus 50 is oscillated little inversely.

TABLE 3

(Unit: %, percentage to Vhm)

| Temperature range | Voltage difference of vibration damping signal (Vsp) |
|---|---|
| T < 15° C. | 40 |
| 15° C. ≦ T ≦ 25° C. | 45-5 × (T-25)/(15-25) |
| 25° C. ≦ T ≦ 40° C. | 50-5 × (T-40)/(25-40) |
| 40° C. < T | 50 |

It is preferable that the voltage holding time (Pw) at the expansion holding waveform element (P4) of the expansion signal (P3, P4), for example, as shown in Table 4 indicated below, prolongs as the environmental temperature T rises. When the voltage difference (Vhm) at the contraction waveform element (P5) of the jet signal (P5, P6) is changed according to the environmental condition T, the jet speed of ink drops is also changed and the ejection position of dots is shifted. On the other hand, when the voltage holding time (Pw) at the expansion holding waveform element (P4) of the expansion signal (P3, P4) is changed, the shift of the dot ejection position is eliminated and a fixed print quality can be kept. When the voltage difference (Vhm) at the contraction waveform element (P5) is changed according to the environmental temperature T, it is necessary to increase the voltage difference (Vhm) aforementioned on the low temperature range. However, by shortening the voltage holding time (Pw) at the expansion holding waveform element (P4) of the expansion signal (P3, P4) within the range of low environmental temperature T, there is no need to increase the voltage difference (Vcp) at the waveform element connection (P2) so much, and the maximum drive voltage VH can be suppressed low, and there is room for design of the recording apparatus.

(Unit: μsec)

| Temperature range | Voltage holding time (Pw) at expansion holding waveform element |
|---|---|
| T < 15° C. | 3 |
| 15° C. ≦ T ≦ 25° C. | 3.5-0.5 × (T-25)/(15-25) |
| 25° C. ≦ T ≦ 40° C. | 3.5 |
| 40° C. < T | 3.5 |

As mentioned above, according to this embodiment, when the ink viscosity is reduced at high temperature around the recording apparatus and the meniscus is apt to be unstable, by changing the waveform of the drive signal according to temperature changes, such as changing the waveform so as to make the movement of the meniscus smaller, it is possible to effectively prevent air bubbles from taking into the nozzle opening, keep the jet characteristics constant, and obtain a fixed print quality.

Figure 9:
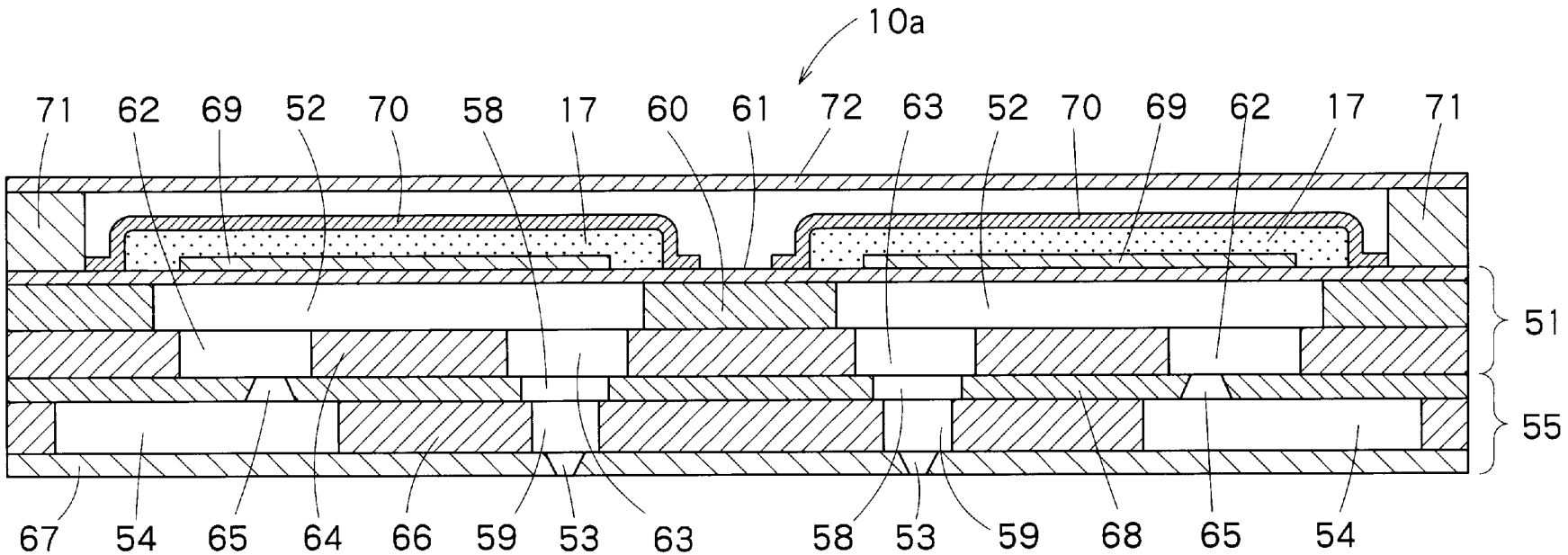
FIG. 9 is a cross sectional view showing the recording head used in the fourth embodiment of the present invention.

FIG. 9 is a cross sectional view showing a recording head 10*a* used in the fourth embodiment of the present invention. This embodiment uses, instead of the recording head 10 having a piezoelectric vibrator in the longitudinal vibration mode in the first to third embodiments mentioned above, the recording head 10*a* having a piezoelectric vibrator in the deflection vibration mode.

The recording head 10*a* has an actuator unit 51 with a plurality of pressure generating chambers 52, a flow path unit 55, adhered to the bottom of the actuator unit 51, with nozzle openings 53 and ink chambers 54, and piezoelectric vibrators 17 adhered to the top of the actuator unit 51. Pressure is generated in the pressure generating chambers 52 by vibration of the piezoelectric vibrators 17, and ink drops are jetted from the nozzle openings 53.

The actuator unit 51 is composed of a pressure generating chamber forming substrate 60 having a space for forming the pressure generating chambers 52, a vibration plate 61 positioned on the top of the pressure generating chamber forming substrate 60 for covering the top opening of the space, and a cover member 64 positioned at the bottom of the pressure generating chamber forming substrate 60. In the cover member 64, a first ink flow path 62 for connecting the ink chambers 54 and the pressure generating chambers 52 and a second ink flow path 63 for connecting the pressure generating chambers 52 and the nozzle openings 53 are formed.

The flow path unit 55 is composed of a storage chamber forming substrate 66 having a space for forming the ink chambers 54, a nozzle plate 67 positioned at the bottom of the storage chamber forming substrate 66, and a feed port forming plate 68 positioned at the top of the storage chamber forming substrate 66. In the storage chamber forming substrate 66, nozzle through-holes 59 connected to the nozzle openings 53 are formed. In the feed port forming plate 68, ink feed ports 65 for feeding ink into the pressure generating chambers 52 via the first ink flow path 62 from the ink chambers 54 are bored and also through holes 58 for connecting the pressure generating chambers 52, the second ink flow path 63, the nozzle through-holes 59, and the nozzle openings 53 are formed.

The piezoelectric vibrators 17 are formed in a flat plate shape on the parts of the top of the vibration plate 61 corresponding to the pressure generating chambers 52. On the bottoms of the piezoelectric vibrators 17, lower electrodes 69 are formed, and on the tops, upper electrodes 70 are formed so as to cover the piezoelectric vibrators 17. At both ends of the top of the actuator unit 51, a terminal 71 conducted to the upper electrode 70 of each piezoelectric vibrator 17 is formed. The top of each terminal 71 is formed higher than the top of each piezoelectric vibrator 17. On the top of each terminal 71, a flexible circuit board 72 is extended and installed so as to input a drive signal to the piezoelectric vibrators 17 via the terminals 71 and the upper electrodes 70. With respect of the pressure generating chambers 52, the piezoelectric vibrators 17, and the terminals 71, only two units are shown in the drawing respectively. However, many units are arranged in the vertical direction of the paper sheet.

In the recording head 10*a*, when a drive waveform is input to the piezoelectric vibrators 17 and the piezoelectric vibrators 17 are charged, the piezoelectric vibrators 17 contract in the horizontal direction. In this case, the bottom side of the piezoelectric vibrators 17 fixed to the vibration plate 61 does not contract and only the top side contracts, so that the piezoelectric vibrators 17 and the vibration plate 61 bend downward and the pressure generating chambers 52 are contracted. And, by increasing of the inner pressure of the pressure generating chambers 52, ink in the pressure generating chambers 52 is jetted as ink drops from the nozzle openings 53 and a recording paper is printed. Then, when the piezoelectric vibrators 17 are discharged, the piezoelectric vibrators 17 and the vibration plate 61 return to their original conditions, and the pressure generating chambers 52 expand, and new ink is fed to the pressure generating chambers 52 from the ink chambers 54 via the ink feed ports 65.

As mentioned above, in the recording head 10*a*, the relationship between the voltage level by charging and discharging of the piezoelectric vibrators 17 and the direction of expansion and contraction of the pressure generating chambers 52 is basically reverse to that of the first to third embodiments.

Figure 10:
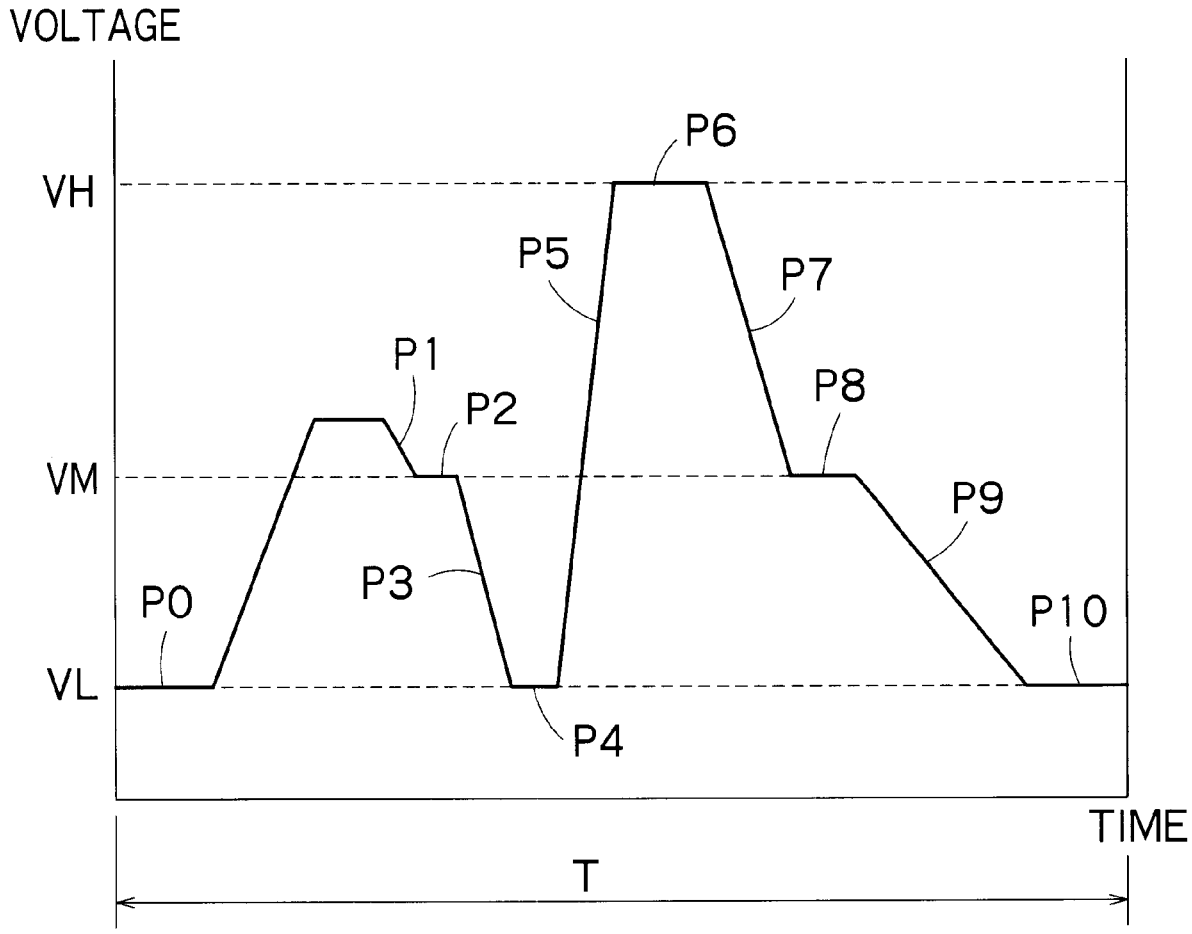
FIG. 10 is an illustration showing a drive signal used in the fourth embodiment of the present invention.

In the recording head 10a, the drive signal shown in FIG. 10 is used. In the first to third embodiments, for expansion of the pressure generating chamber 31, a drive signal in a waveform for increasing the voltage is used and for jet of ink drops, a drive signal in a waveform for decreasing the voltage is used. On the other hand, in the recording head 10*a* of the present embodiment, for expansion of the pressure generating chambers 52, a drive signal in a waveform for decreasing the voltage is used and for contraction of the pressure generating chambers 52, a drive signal in a waveform for increasing the voltage is used. Also in this case, the same operations and effects as those in the first to third embodiments aforementioned can be produced.

As mentioned above, according to the present invention, the initial voltage and terminal voltage of the drive signal, which is equivalent to the standby voltage of the piezoelectric vibrators, are set lower than the standby voltage of the drive signal of the conventional recording apparatus. As a result, the voltage difference when the vibrator voltage, which is dropped due to discharge, is recovered to the standby voltage using the voltage recovery means is lower than that of the conventional recording apparatus. Therefore, accidental jetting of ink drops, at the time of recovery of the vibrator voltage to the standby voltage, is surely prevented.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. An ink-jet recording apparatus comprising:

a recording head having a piezoelectric vibrator for expanding and contracting a pressure generating chamber connected to a nozzle opening; and drive signal generator for generating a drive signal to be applied to said piezoelectric vibrator so as to drive said piezoelectric vibrator;

wherein said drive signal includes an expansion waveform element for changing a voltage so as to expand said pressure generating chamber, a contraction waveform element for changing a voltage so as to contract said pressure generating chamber expanded by said expansion waveform element and jet an ink drop from said nozzle opening, and a vibration damping waveform element which changes from a terminal voltage of said contraction waveform element to a vibration damping voltage so as to expand said pressure generating chamber contracted by said contraction waveform element in order to suppress a residual vibration of a meniscus of said pressure generating chamber after jetting said ink drop, wherein an initial voltage and a terminal voltage of said drive signal are equal to each other and equivalent to a standby voltage which is set as a voltage of said piezoelectric vibrator at a time of non-supply of said drive signal, and wherein said vibration damping voltage lies between said standby voltage and a maximum voltage of said drive signal.

2. An ink-jet recording apparatus according to claim 1, wherein said expansion waveform element includes a front part of waveform element, a back part of waveform element positioned behind said front part of waveform element, and a waveform element connection for connecting a terminal end of said front part of waveform element and a starting end of said back part of waveform element, wherein said waveform element connection is positioned at an intermediate voltage between said standby voltage and said maximum voltage, and wherein an inclination of said front part of waveform element is smaller than an inclination of said back part of waveform element.

3. An ink-jet recording apparatus according to claim 2, wherein a difference between said standby voltage and said intermediate voltage is reduced in accordance with rising of an environmental temperature.

4. An ink-jet recording apparatus according to claim 2, wherein a continuation time of said front part of waveform element is set longer than an intrinsic vibration cycle of said pressure generating chamber.

5. An ink-jet recording apparatus according to claim 1, wherein said drive signal includes a return waveform element which is positioned behind said vibration damping waveform element and changes from said vibration damping voltage to said standby voltage.

6. An ink-jet recording apparatus according to claim 5, wherein an inclination of said return waveform element is smaller than an inclination of said contraction waveform element.

7. An ink-jet recording apparatus according to claim 5, wherein a continuation time of said return waveform element is set longer than said intrinsic vibration cycle of said pressure generating chamber.

8. An ink-jet recording apparatus according to claim 1, wherein said standby voltage is a minimum voltage of said drive signal.

9. An ink-jet recording apparatus according to claim 2, wherein a continuation time of said back part of waveform element is set longer than an intrinsic vibration cycle of said piezoelectric vibrator and shorter than said intrinsic vibration cycle of said pressure generating chamber.

10. An ink-jet recording apparatus according to claim 1, wherein a continuation time of said contraction waveform element is set longer than an intrinsic vibration cycle of said piezoelectric vibrator.

11. An ink-jet recording apparatus according to claim 1, wherein a continuation time of said vibration damping waveform element is set longer than an intrinsic vibration cycle of said piezoelectric vibrator.

12. An ink-jet recording apparatus according to claim 1, wherein a contraction holding waveform element for holding a contraction condition of said pressure generating chamber contracted by said contraction waveform element succeeds said contraction waveform element and a total continuation time of said contraction waveform element and said contraction holding waveform element is set so as to be made practically equal to integer times of said intrinsic vibration cycle of said pressure generating chamber.

13. An ink-jet recording apparatus according to claim 12, wherein said total continuation time of said contraction waveform element and said contraction holding waveform element is set so as to be made practically equal to said intrinsic vibration cycle of said pressure generating chamber.

14. An ink-jet recording apparatus according to claim 1, wherein a voltage difference of said contraction waveform element itself is reduced in accordance with rising of an environmental temperature.

15. An ink-jet recording apparatus according to claim 1, wherein a voltage difference of said vibration damping waveform element itself is increased in accordance with rising of an environmental temperature.

16. An ink-jet recording apparatus according to claim 1, wherein an expansion holding waveform element for holding an expansion condition of said pressure generating chamber expanded by said expansion waveform element succeeds said expansion waveform element, and wherein a continuation time of said expansion holding waveform element is increased in accordance with rising of said environmental temperature.

17. A method for driving an ink-jet recording head having a piezoelectric vibrator for expanding and contracting a pressure generating chamber connected to a nozzle opening, comprising:

a step of generating a drive signal to be applied to said piezoelectric vibrator so as to drive said piezoelectric vibrator; and a step of applying said drive signal to said piezoelectric vibrator and driving said piezoelectric vibrator;

wherein said drive signal includes an expansion waveform element for changing a voltage so as to expand said pressure generating chamber, a contraction waveform element for changing a voltage so as to contract said pressure generating chamber expanded by said expansion waveform element and jet an ink drop from said nozzle opening, and a vibration damping waveform element for changing a voltage from a terminal voltage of said contraction waveform element to a vibration damping voltage so as to expand said pressure generating chamber contracted by said contraction waveform element in order to suppress a residual vibration of a meniscus of said pressure generating chamber after jetting said ink drop, wherein an initial voltage and a terminal voltage of said drive signal are equal to each other and equivalent to a standby voltage set as a voltage of said piezoelectric vibrator at a time of non-supply of said drive signal, and wherein said vibration damping voltage lies between said standby voltage and a maximum voltage of said drive signal.

18. A method for driving an ink-jet recording head according to claim 17, wherein said expansion waveform element includes a front part of waveform element, a back part of waveform element positioned behind said front part of waveform element, and a waveform element connection for connecting a terminal end of said front part of waveform element and a starting end of said back part of waveform element, wherein said waveform element connection is positioned at an intermediate voltage between said standby voltage and said maximum voltage, and wherein an inclination of said front part of waveform element is smaller than an inclination of said back part of waveform element.

19. A method for driving an ink-jet recording head according to claim 18, wherein a difference between said standby voltage and said intermediate voltage is reduced in accordance with rising of an environmental temperature.

20. A method for driving an ink-jet recording head according to claim 18, wherein a continuation time of said front part of waveform element is set longer than an intrinsic vibration cycle of said pressure generating chamber.

21. A method for driving an ink-jet recording head according to claim 17, wherein said drive signal includes a return waveform element which is positioned behind said vibration damping waveform element and changes from said vibration damping voltage to said standby voltage.

22. A method for driving an ink-jet recording head according to claim 21, wherein an inclination of said return waveform element is smaller than an inclination of said contraction waveform element.

23. A method for driving an ink-jet recording head according to claim 21, wherein a continuation time of said return waveform element is set longer than said intrinsic vibration cycle of said pressure generating chamber.

24. A method for driving an ink-jet recording head according to claim 17, wherein said standby voltage is a minimum voltage of said drive signal.

25. A method for driving an ink-jet recording head according to claim 18, wherein a continuation time of said back part of waveform element is set longer than an intrinsic vibration cycle of said piezoelectric vibrator and shorter than said intrinsic vibration cycle of said pressure generating chamber.

26. A method for driving an ink-jet recording head according to claim 17, wherein a continuation time of said contraction waveform element is set longer than said intrinsic vibration cycle of said piezoelectric vibrator.

27. A method for driving an ink-jet recording head according to claim 17, wherein a continuation time of said vibration damping waveform element is set longer than said intrinsic vibration cycle of said piezoelectric vibrator.

28. A method for driving an ink-jet recording head according to claim 17, wherein a contraction holding waveform element for holding a contraction condition of said pressure generating chamber contracted by said contraction waveform element succeeds said contraction waveform element, and wherein a total continuation time of said contraction waveform element and said contraction holding waveform element is set so as to be made practically equal to integer times of said intrinsic vibration cycle of said pressure generating chamber.

29. A method for driving an ink-jet recording head according to claim 28, wherein said total continuation time of said contraction waveform element and said contraction holding waveform element is set so as to be made practically equal to said intrinsic vibration cycle of said pressure generating chamber.

30. A method for driving an ink-jet recording head according to claim 17, wherein a voltage difference of said contraction waveform element itself is reduced in accordance with rising of an environmental temperature.

31. A method for driving an ink-jet recording head according to claim 17, wherein a voltage difference of said vibration damping waveform element itself is increased in accordance with rising of an environmental temperature.

32. A method for driving an ink-jet recording head according to claim 17, wherein an expansion holding waveform element for holding an expansion condition of said pressure generating chamber expanded by said expansion waveform element succeeds said expansion waveform element, and wherein a continuation time of said expansion holding waveform element is increased in accordance with rising of an environmental temperature.

* * * * *